US011284689B1

(12) United States Patent
Duncan

(10) Patent No.: US 11,284,689 B1
(45) Date of Patent: Mar. 29, 2022

(54) WALLET MONEY CLIP

(71) Applicant: POV Mounting Systems, LLC, Matthews, NC (US)

(72) Inventor: Larry C. Duncan, Matthews, NC (US)

(73) Assignee: POV MOUNTING SYSTEMS, LLC, Matthews, NC (US)

( * ) Notice: Subject to any disclaimer, the term of this patent is extended or adjusted under 35 U.S.C. 154(b) by 293 days.

(21) Appl. No.: 16/398,238

(22) Filed: Apr. 29, 2019

Related U.S. Application Data

(60) Provisional application No. 62/664,075, filed on Apr. 27, 2018.

(51) Int. Cl.
*A45C 1/06* (2006.01)
*A45C 13/00* (2006.01)

(52) U.S. Cl.
CPC ..... *A45C 1/06* (2013.01); *A45C 13/005* (2013.01); *A45C 2001/062* (2013.01); *A45C 2001/065* (2013.01)

(58) Field of Classification Search
CPC ... A45C 13/005; A45C 1/06; A45C 2001/062; A45C 2001/065
USPC ..... 150/137, 147
See application file for complete search history.

(56) References Cited

U.S. PATENT DOCUMENTS

| | | | | | |
|---|---|---|---|---|---|
| 2,061,773 | A * | 11/1936 | O'Hagan | B61L 23/168 | 246/34 R |
| 2,619,699 | A * | 12/1952 | Meeker | B42F 1/006 | 24/561 |
| 3,369,585 | A * | 2/1968 | Martinsen | A45C 11/182 | 206/37 |
| 3,970,129 | A * | 7/1976 | Tepfer | A45C 11/18 | 150/149 |
| 2003/0140996 | A1* | 7/2003 | Thomson | B42F 1/006 | 150/138 |
| 2017/0112248 | A1* | 4/2017 | Haarburger | A45C 11/182 | |
| 2017/0119115 | A1* | 5/2017 | King | A45C 13/30 | |
| 2017/0135452 | A1* | 5/2017 | Kane | A45C 13/185 | |
| 2018/0064223 | A1* | 3/2018 | Singer | A45C 1/06 | |
| 2019/0075901 | A1* | 3/2019 | Shields | A45C 11/182 | |

* cited by examiner

*Primary Examiner* — Sue A Weaver
(74) *Attorney, Agent, or Firm* — Everman Law Firm, P.A.; Gregory R. Everman

(57) ABSTRACT

A self-closing wallet money clip that can be used to carry banknotes and personal items such as credit cards, business cards, and identification documents for example a driver's license. The wallet money clip includes a first plate, a second plate, a plurality of articulation mechanisms joining the first plate to the second plate and allowing for relative movement between the first plate and second plate, and an elastic band biasing the wallet money clip to a closed position. The wallet money clip can also include a clip for holding banknotes.

20 Claims, 16 Drawing Sheets

WALLET MONEY CLIP

CROSS REFERENCE TO RELATED APPLICATIONS

This application claims the benefit of U.S. Provisional Application No. 62/664,075, filed Apr. 27, 2018, which is incorporated herein by reference in its entirety.

FIELD OF THE INVENTION

This invention relates generally to wallets and money clips that can be used to carry banknotes and personal items such as credit cards, business cards, and identification documents for example a driver's license. More particularly, the present invention is a self-closing wallet money clip that can be used to carry the aforementioned items.

BACKGROUND OF THE INVENTION AND RELATED ART

Wallets are commonly used by a person to carry personal items, for example cash, credit cards and business cards, and identification documents such as a driver's license. Wallets are generally made of leather or fabrics, bi-fold or tri-fold, and have an open top to access a large longitudinally bifurcated pocket for holding banknotes, smaller pockets for holding credit cards, club cards and the like, and a pocket with a transparent window for holding a driver's license.

Conventional wallets are not self-closing and therefore items, for example banknotes, can fall out of the large longitudinal pocket when the wallet is held upside down. And although a conventional wallet can be opened wide to hold a larger quantity of banknotes, this disadvantageously causes the top of the wallet to be widely gapped open whereby the risk of banknotes falling out of the wallet is increased.

Smaller pockets within conventional wallets can become stretched from use whereby items placed therein can fall out when the wallet is held upside down. For example, placement of several credit cards in a smaller pocket may cause the pocket to become stretched out such that when fewer cards are placed in the pocket they may not be sufficiently secure and slide out.

Money clips are another conventional device used to carry banknotes and credit cards and provide an advantage over wallets by being adapted to carry these items in a very compact fashion. Money clips are often made of metal and are generally a solid piece of metal folded into half, such that back notes and credit cards can be securely wedged in between the two pieces of metal. A disadvantage of conventional metal money clips is that the two halves cannot be easily separated nor can they hold a large amount of credit cards or banknotes. This issue is exacerbated by the configuration of convention money clips in which the holding force is exerted only at the distal ends of the two halves.

Another disadvantage of conventional money clips is that the act of opening the clip to insert or retrieve an item causes the remaining items to fall out of the clip unless a person minds the items.

Another known device is a wallet money clip which combines features of a wallet and a money clip. Typically the money clip aspect is hingedly attached to the wallet and utilizes magnets at its distal end to secure the money clip in a closed position. The hinge allows for the money clip to be open wide; however, relatively few banknotes can be securely held due to the modest strength of the magnets.

In view of the aforementioned deficiencies, there exists a need for a wallet money clip capable of securely maintaining banknotes and credit cards. There also exists a need for a wallet money clip that can be held open for inserting or retrieving items while maintaining other items within the device from falling out. There exists a further need for a wallet money clip to meet the aforementioned functionality while having of a unique fashionable design.

SUMMARY OF THE INVENTION

The present invention is a self-closing wallet money clip that can be used to carry banknotes and personal items such as credit cards, business cards, and identification documents for example a driver's license.

In an aspect, the invention is embodiment by a wallet money clip having a first plate, a second plate, a plurality of articulation mechanisms joining the first plate to the second plate and allowing for relative movement between the first plate and second plate, wherein the first plate, the second plate and the plurality of articulation mechanisms form a pocket capable of holding a credit card, and an actuator biasing the wallet money clip to a closed position. In an aspect, the actuator is a single elastic band. In another aspect the actuator is a plurality of elastic bands. In a further aspect, the elastic band includes a plurality of band sections that extend between the first plate and the second plate. For example, the plurality of band sections may be three or more band sections, or four or more band sections. In a still further aspect, the plurality of band sections are laterally spaced from each other.

In another aspect of the invention, the plurality of articulation mechanisms includes at least two distal articulation mechanisms and at least two proximal articulation mechanisms. In a further aspect, each of the plurality of articulation mechanisms includes a connecting rod that defines a distance between the first plate and the second plate when the wallet money is in the open position. In yet another aspect, the two distal articulation mechanisms are joined by a shaft and the two proximal articulation mechanisms are joined by a shaft. In a still further aspect, the first plate has a frontal notch and the second plate has a front notch wherein the frontal notch of the second plate and the frontal notch of the first plate perpendicularly coincide when the wallet money clip is in the open position.

Other aspects, objects, features and advantages of the invention will be made apparent or will be readily understood and appreciated by those skilled in the related art as the invention is described in greater detail hereinafter and is shown in the accompanying drawing figures. It is envisioned that all such aspects, objects, features and advantages of the invention as shown and described herein will be within the intended broad scope of the appended claims. The above and other aspects, objects, features and advantages may be accomplished by any of the exemplary embodiments of the invention described herein and illustrated in the accompanying drawings. However, it should be appreciated that the drawing figures are for illustrative purposes only, and that many modifications, changes, revisions and substitutions may be made to the exemplary embodiments illustrated herein without departing from the broadest reasonable interpretation of the appended claims.

BRIEF DESCRIPTION OF THE DRAWINGS

The aforementioned objects, features and attendant advantages of the invention will be more fully understood and appreciated when considered in conjunction with the accompanying drawings.

DETAILED DESCRIPTION OF THE EXEMPLARY EMBODIMENTS

Figure 1:
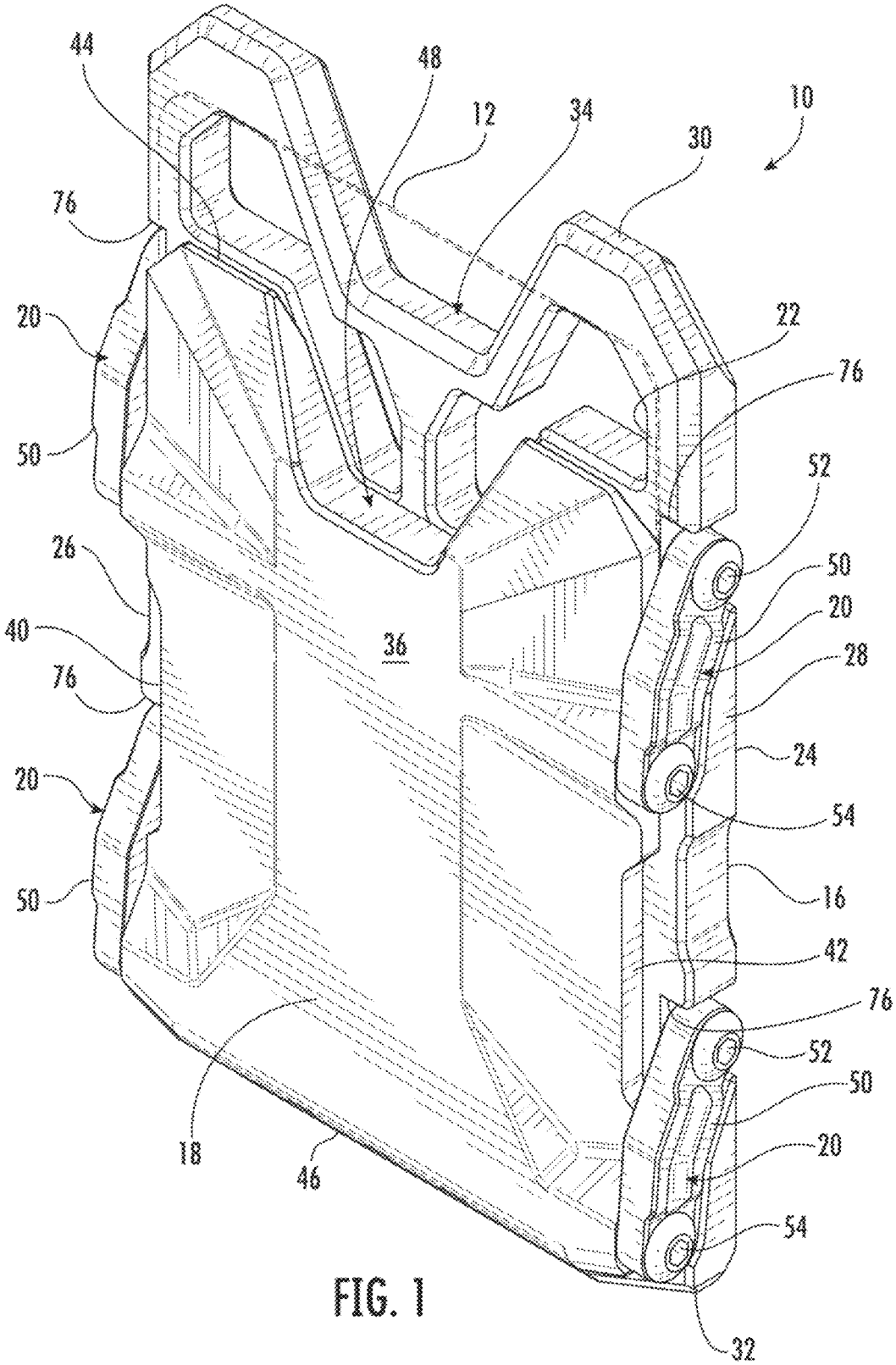
FIG. 1 is a top, right, front perspective view of a wallet money clip showing a credit card being held by the wallet money clip in accordance with an exemplary embodiment of the invention.

The present invention will now be described more fully hereinafter with reference to the accompanying drawings in which preferred embodiments of the invention are shown. This invention may, however, be embodied in many different forms and should not be considered as limited to the embodiments set forth herein. These exemplary embodiments are provided so that this disclosure will be both thorough and complete, and will fully convey the scope of the invention to those skilled in the art. Throughout the several views of the drawings, like reference characters designate the same or similar parts. This application incorporates by reference U.S. Provisional Application No. 62/664,075 in its entirety.

Figure 8:
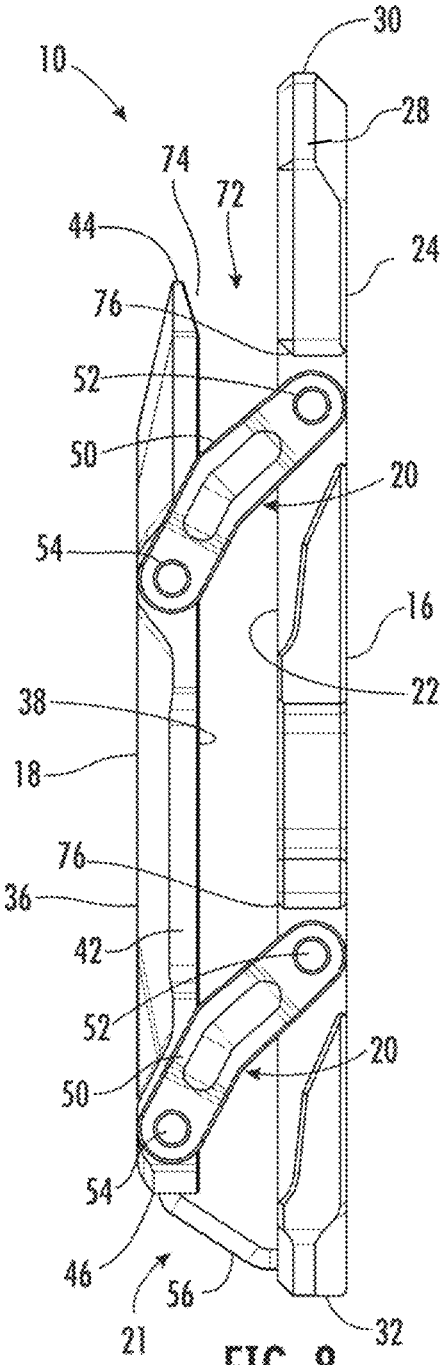
FIG. 8 is a right side elevational view of the wallet money clip of FIG. 4, showing the wallet money clip in an open position.
Figure 8A:
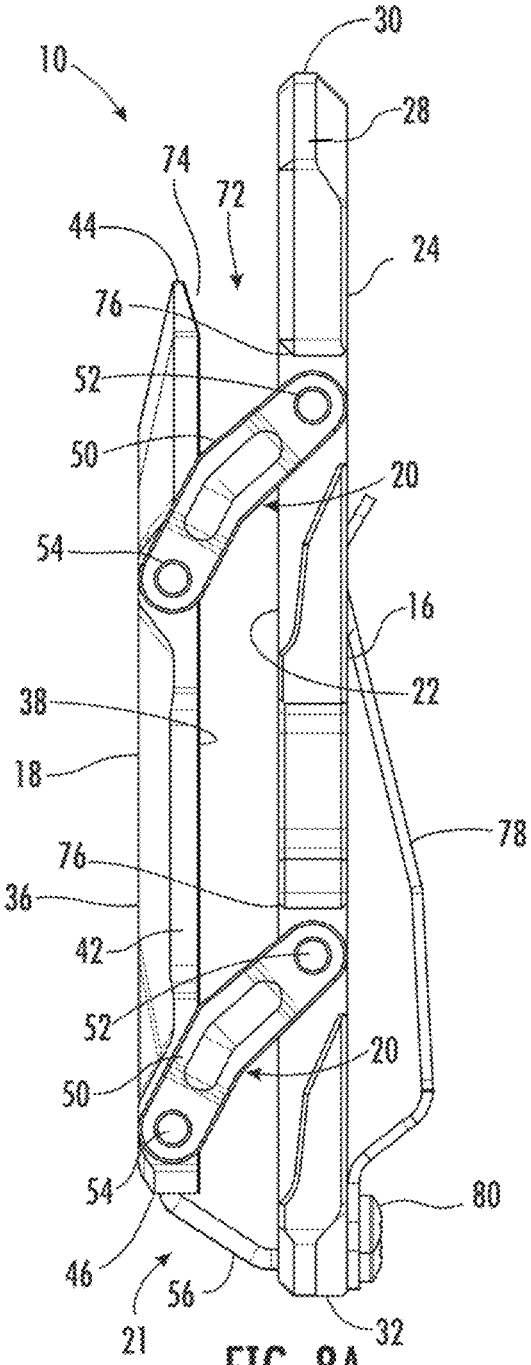
FIG. 8A is a right side elevational view of the wallet money clip of FIG. 4A, showing the wallet money clip in an open position.
Figure 8B:
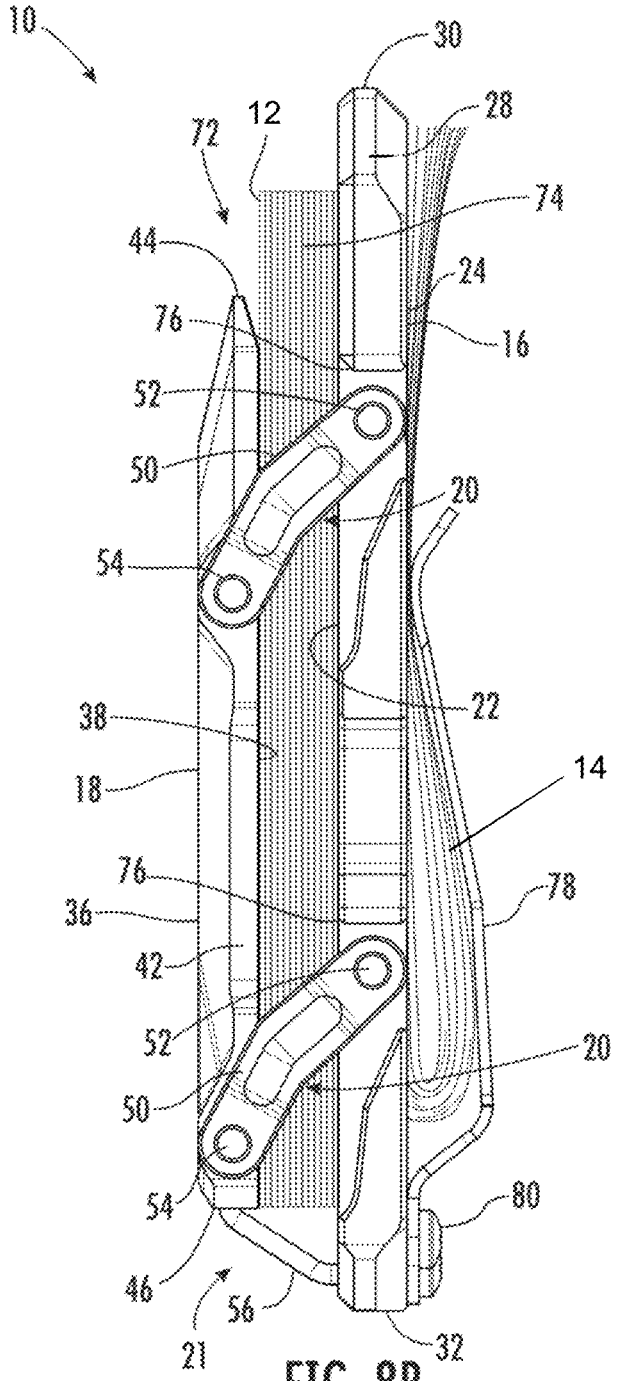
FIG. 8B is a right side elevational view of the wallet money clip of FIG. 4A, showing the wallet money clip holding credit cards and banknotes.
Figure 9:
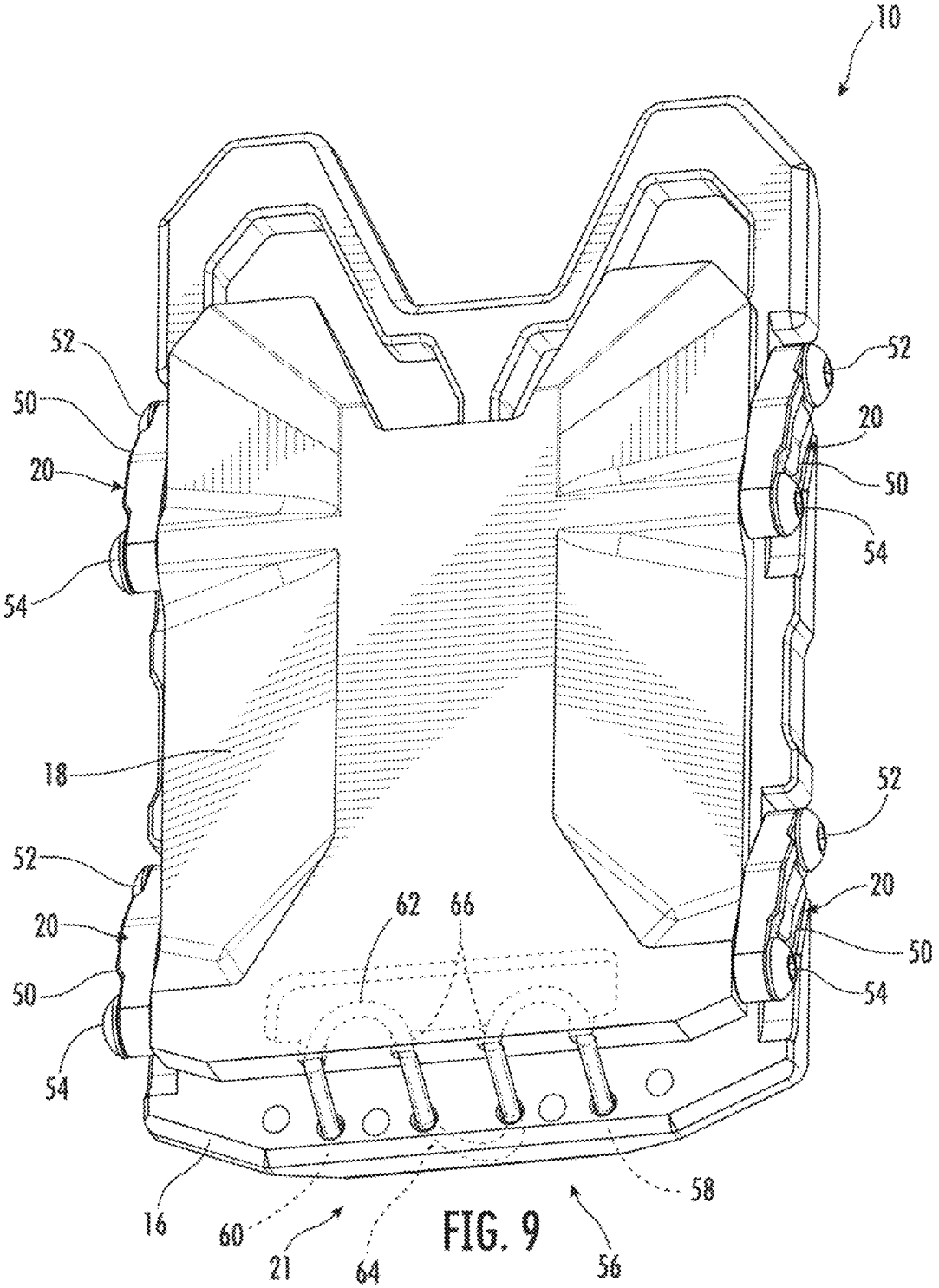
FIG. 9 is a top, right, front perspective view of a wallet money clip in an open position in accordance with an exemplary embodiment of the invention.
Figure 10:
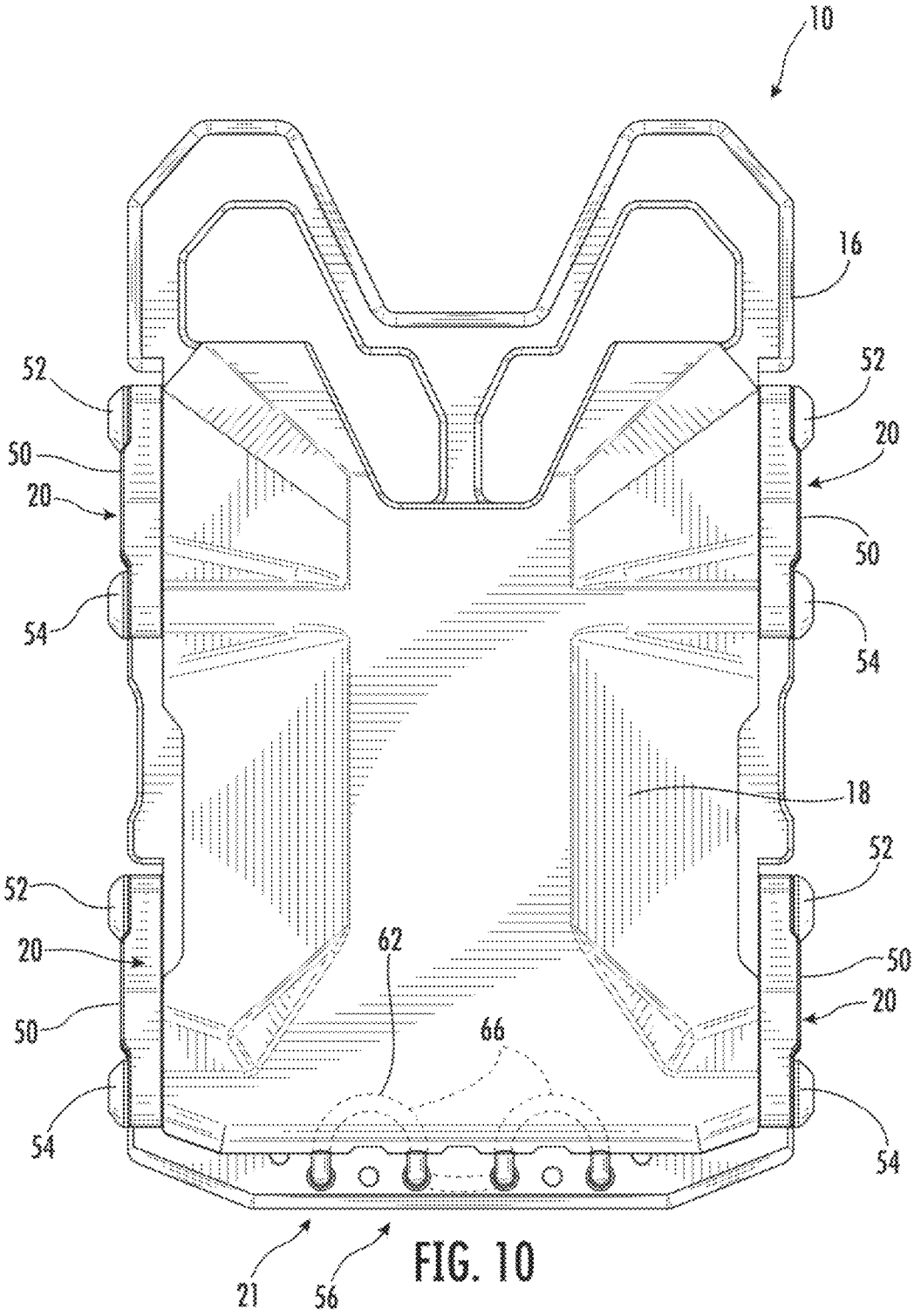
FIG. 10 is a top, right, front perspective view of a wallet money clip of FIG. 9 in a closed position.

FIGS. 1-15 illustrate exemplary embodiments of a wallet money clip, designated generally by reference character 10, according to the invention. In the exemplary embodiments shown and described herein, the wallet money clip 10 facilitates the carrying of personal items such as credit cards, and business cards, and identification documents such as a driver's license (individually and collectively "cards" 12) and banknotes 14. (see FIGS. 1, 8B and 13).

The wallet money clip 10 includes a first plate 16, a second plate 18 generally opposed to the first plate 16, a plurality of articulation mechanisms 20 joining and allowing relative movement between the first plate 16 and second plate 18, and an actuator 21 for biasing the wallet money clip 10 to a closed position. In the preferred embodiments, two articulation mechanisms 20 are provided on the right side and two articulation mechanisms 20 are provided on the left side of the wallet money clip 10. It is noted that in this arrangement can also be described as having two articulation mechanisms 20 distally provided and two articulation mechanisms 20 proximally provided on the wallet money clip 10. Although four articulation mechanisms 20 are illustrated, it is to be understood that a different number of articulation mechanisms 20 may be used.

The first plate 16 forms a base of the wallet money clip 10 and is generally shaped as a thin rectangular prism with top, bottom, left, right, front and rear surfaces (22, 24, 26, 28, 30 and 32, respectively) with a proximal frontal notch 34 which forms at least a portion of the front surface 30. The second plate 18 forms a top of the wallet money clip 10 and is generally shaped as a thin rectangular prism with top, bottom, left, right, front and rear surfaces (36, 38, 40, 42, 44 and 46 respectively) with a proximal frontal notch 48 which forms at least a portion of the front surface 44.

Referring to FIGS. 1-12, each of the articulation mechanisms 20 includes a connecting rod 50 pivotally mounted at one end (via a shaft 52) to the periphery of the first plate 16 and pivotally mounted at an opposed end (via a shaft 54) to the periphery of the second plate 18. The shafts 52 and 54 are received and secured by complementary threaded openings 53, 55 in the first plate 16 and second plate 18, respectively, whereby opening and closing of the wallet money clip 10 causes each connecting rod 50 to rotate relative to its respective shafts 52, 54.

Figure 13:
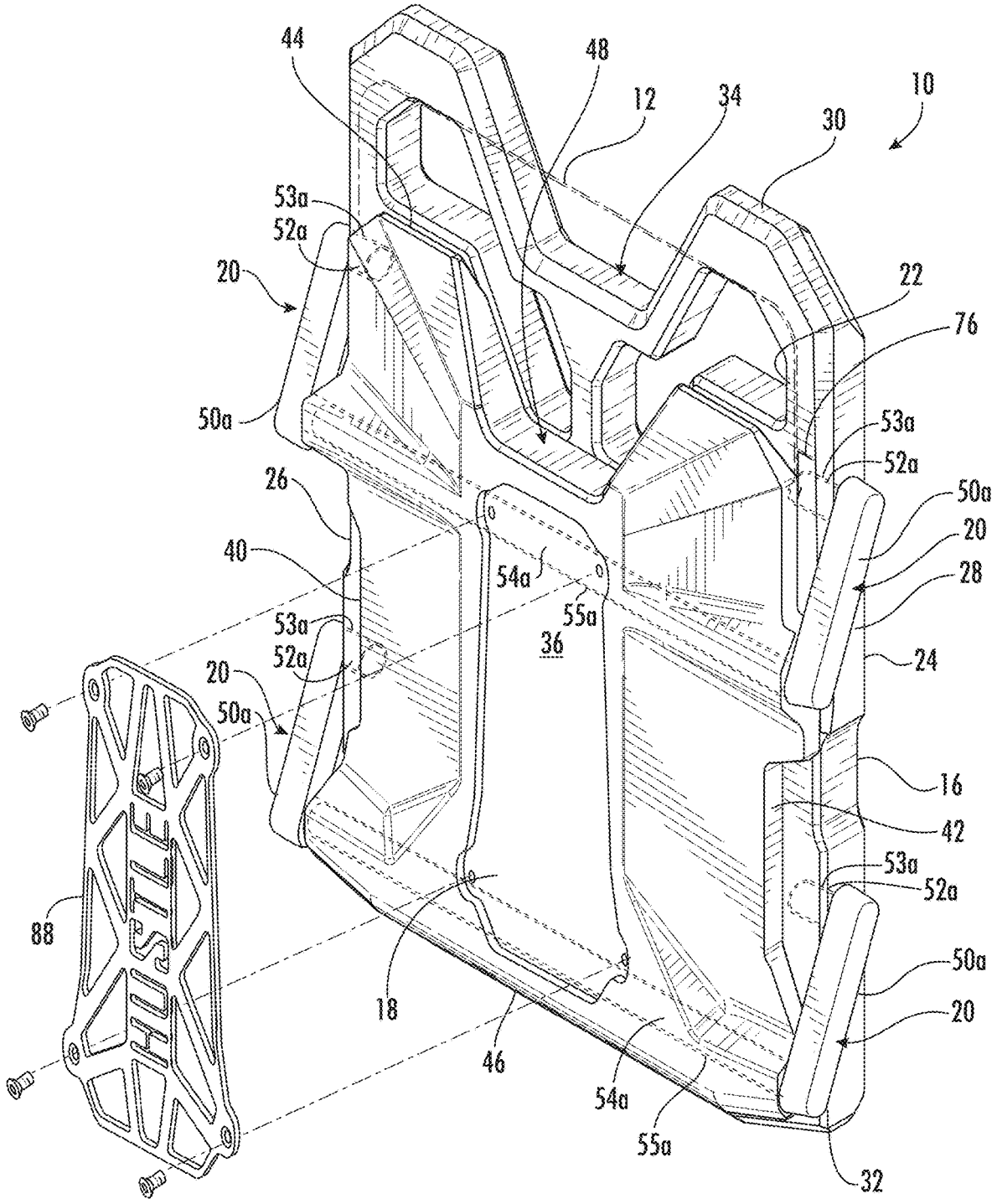
FIG. 13 is a top, right, front perspective view of a wallet money clip showing a credit card being held by the wallet money clip in accordance with an exemplary embodiment of the invention.
Figure 14:
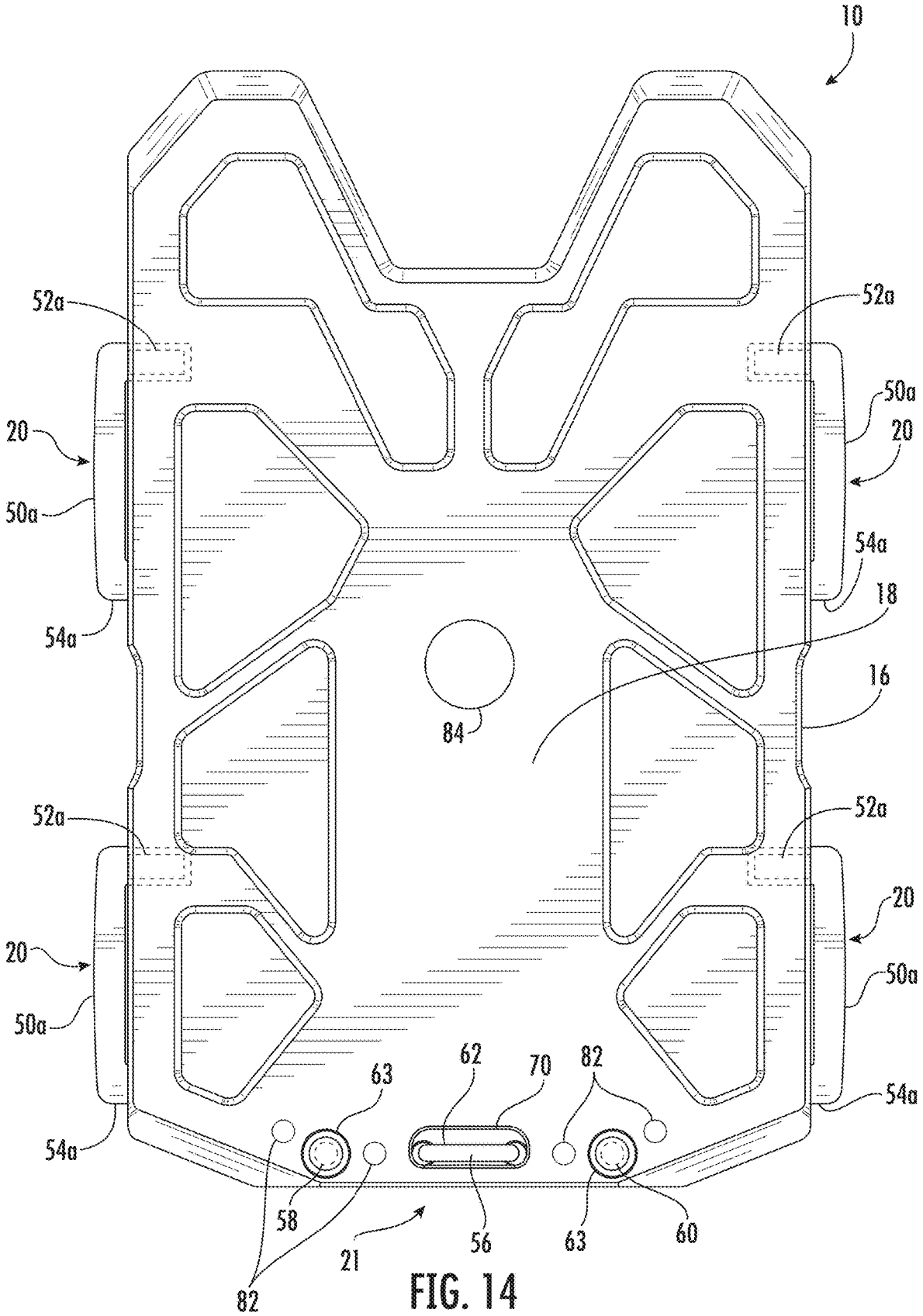
FIG. 14 is a bottom plan view of the wallet money clip of FIG. 13, showing a magnet used to releasable secure an optional money clip as illustrated in FIG. 15.
Figure 15:
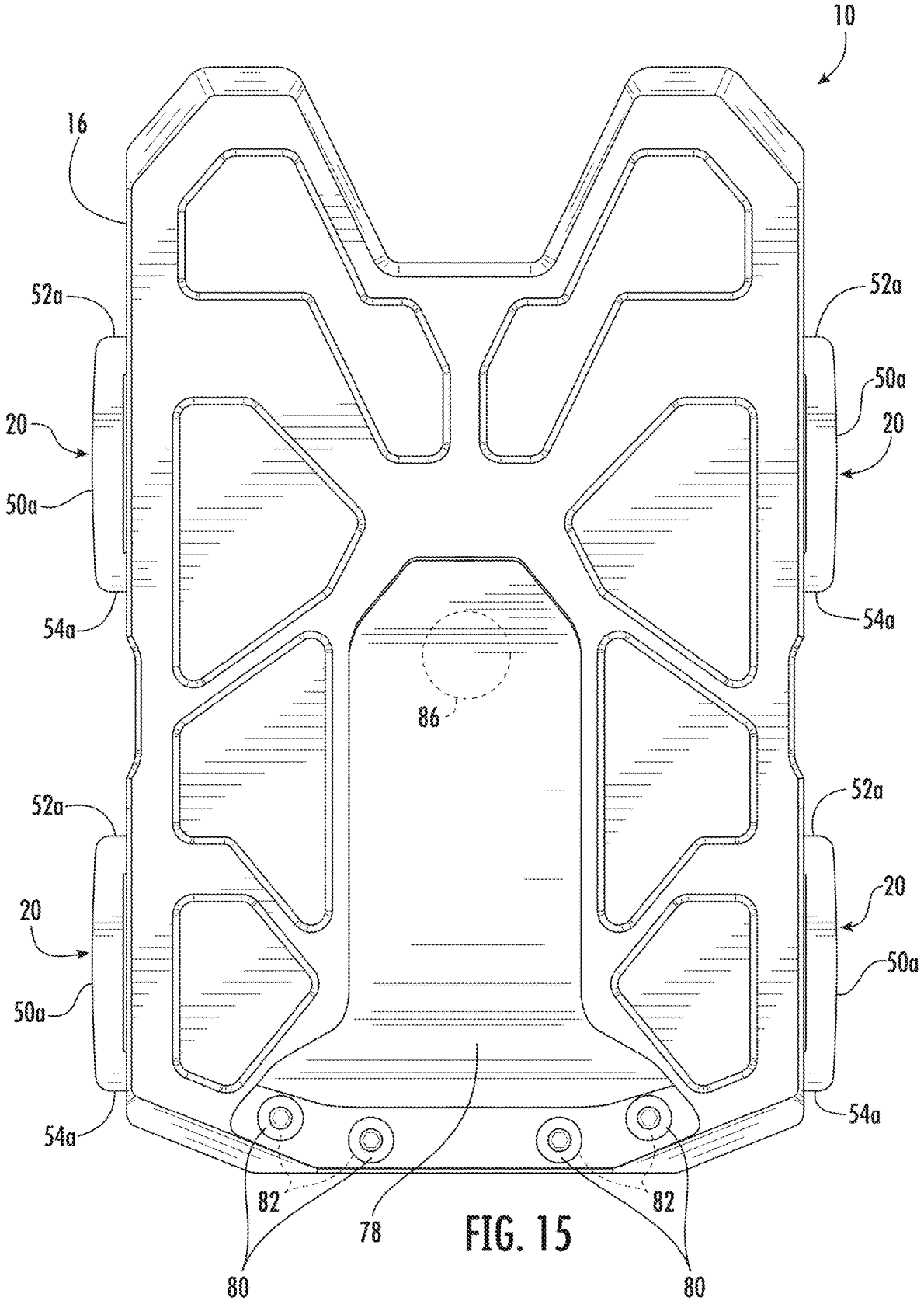
FIG. 15 is a bottom plan view of the wallet money clip of FIG. 13, further showing an optional money clip in accordance with an exemplary embodiment of the invention.

Referring to FIGS. 13-15, in an embodiment the pair of distal articulation mechanisms 20 are of a unitary configuration, each having a shaft 52*a* received by an opening 53*a* in the first plate 16, a connecting rod 50*a* intermediate the shaft 52*a* and a common shaft 54*a*, wherein the common shaft 54*a* laterally traverses the second plate 18 through an opening 55*a* and joins the pair of distal articulation mechanisms 20. As such, opening and closing of the wallet money clip 10 causes the pair of distal articulation mechanisms 20 to move in concert whereby shafts 52*a* rotate relative to the first plate 16 and shafts 54*a* to rotate relative to the second plate 18 causing the connecting rod 50*a* to define a distance in a range of closed to fully open between the first plate 16 and second plate 18.

Likewise, the pair of proximal articulation mechanisms 20 are of a unitary configuration, each having a shaft 52*a* received by an opening 53*a* in the first plate 16, a connecting rod 50*a* intermediate the shaft 52*a* and a common shaft 54*a*, wherein the common shaft 54*a* laterally traverses the second plate 18 through an opening 55*a* and joins the pair of proximal articulation mechanisms 20. As such, opening and closing of the wallet money clip 10 causes pair of proximal articulation mechanisms 20 to move in concert whereby shafts 52*a* rotate relative to the first plate 16 and shafts 54*a* to rotate relative to the second plate 18 causing the connecting rod 50*a* to define a distance in a range of closed to fully open between the first plate 16 and second plate 18.

Referring to FIGS. 1-15, the arrangement of articulation mechanisms 20 allows the first plate 16 to be translated upwards and forwards relative to the second plate 18 when being moved from a closed position to an open position, and translated downward and rearwards when being moved from an open position to a closed position. Additionally, while being opened and closed the plane of the top face 22 of the first plate 16 and the plane of the bottom face 38 second plate 18 maintain their orientation to each other preferably within 10 degrees, more preferably within 5 degrees, whereby the faces 16, 38 engage each other over a large area or, when holding one or more cards 12, engage a single card 12 (or where there is a plurality of cards, the outer cards 12) placed there-between over a large area.

The actuator 20 includes a resilient elastic band 56 having first and second ends 58, 60 attached to the first plate 16 and an intermediate portion 62 in communication with the second plate 18 whereby the elastic band 56 stretches in tension as the second plate 18 is being moved to the open position. It is to be understood the wallet money clip 10 may alternatively be configured whereby the elastic band 56 has first and second ends 58, 60 attached to the second plate 18 and an intermediate portion 62 in communication with the first plate 16 whereby the elastic band 56 stretches in tension as the second plate 18 is being moved to the open position.

In the preferred embodiment, a single band 56 is utilized with its ends 58, 60 enlarged and disposed in respective counterbores 63 so that they do not pull through passages 64, 66 formed in the first and second plates 16, 18 and which contain the intermediate portion 62 of the band 56. In the second plate 18, the passage 66 is comprised of a series of passageways 66*a* in order to provide the band 56 a desired length corresponding to a select amount of tension and holding force.

Figure 2:
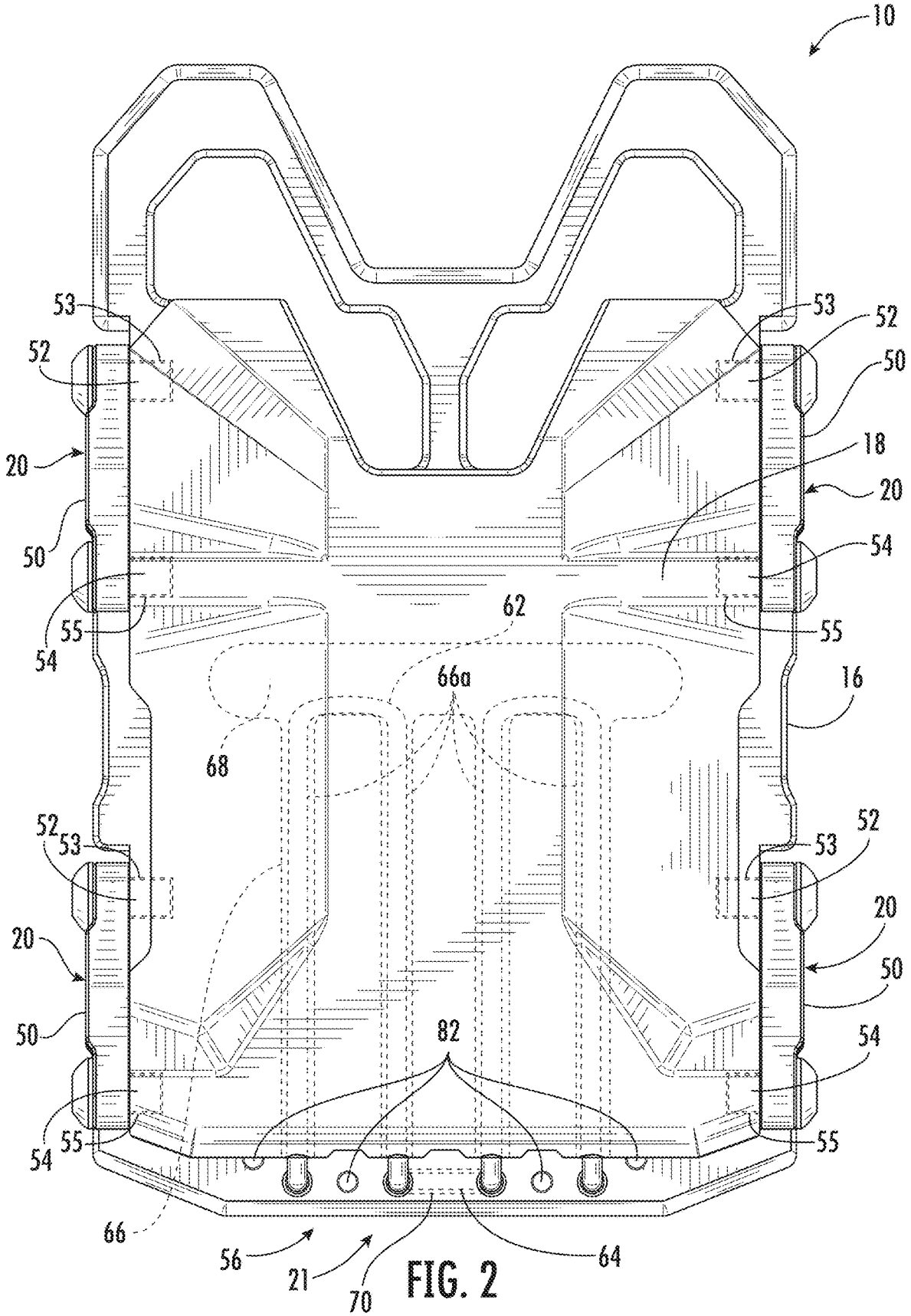
FIG. 2 is a top plan view of the wallet money clip of FIG. 1.
Figure 3:
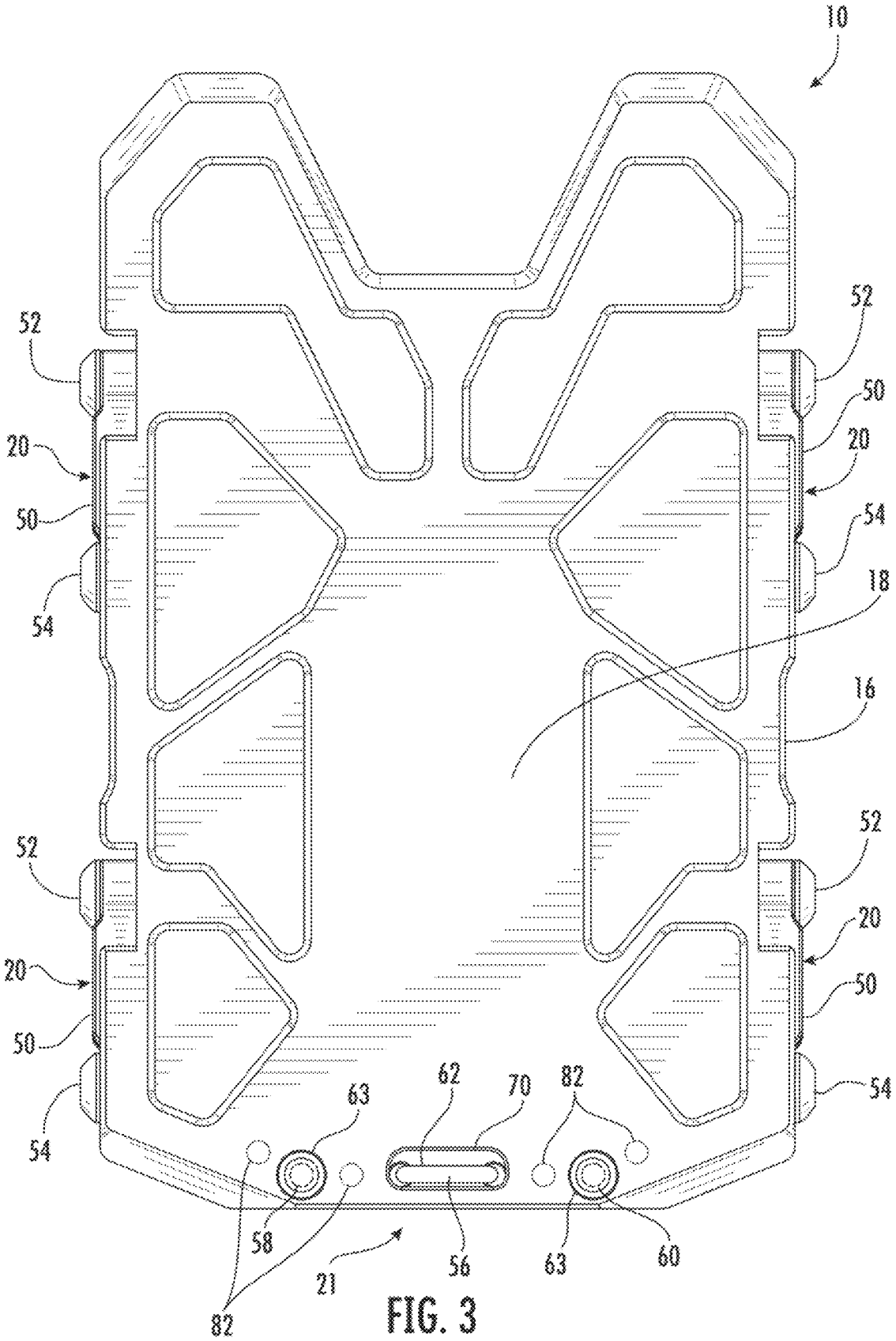
FIG. 3 is a bottom plan view of the wallet money clip of FIG. 1.
Figure 3A:
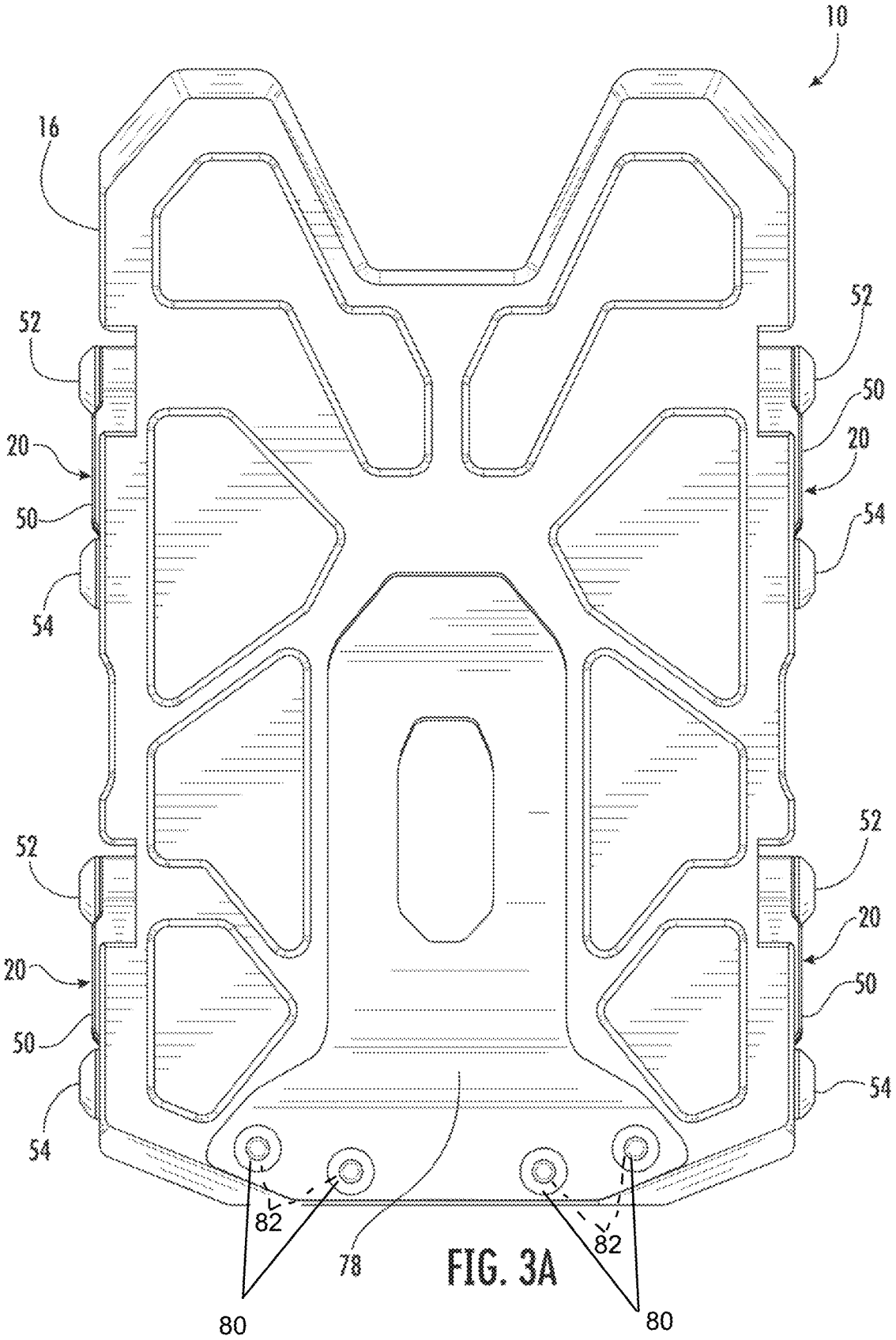
FIG. 3A is a bottom plan view of the wallet money clip of FIG. 1, further showing an optional money clip in accordance with an exemplary embodiment of the invention.
Figure 4:
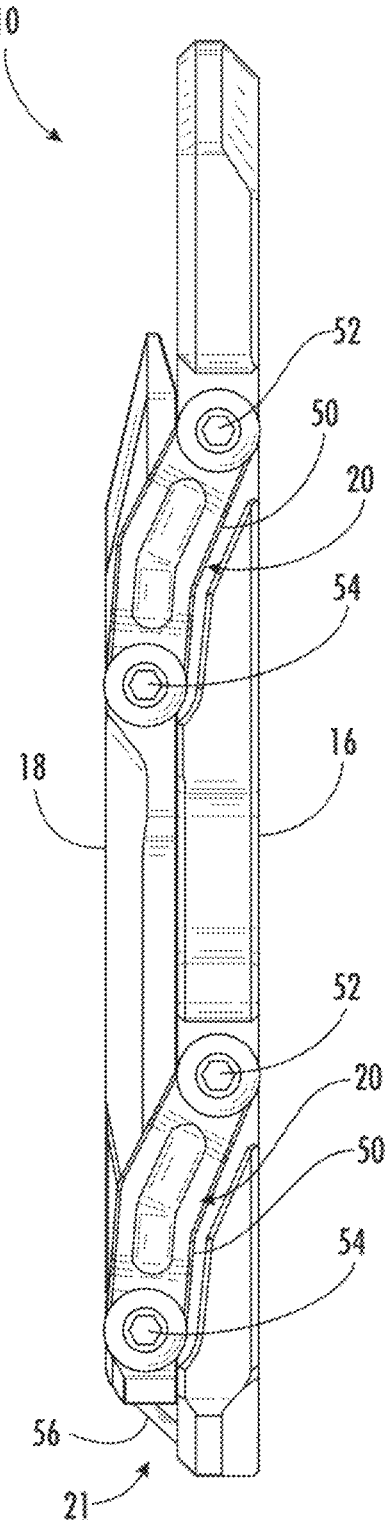
FIG. 4 is a right side elevational view of the wallet money clip of FIG. 1.
Figure 5:
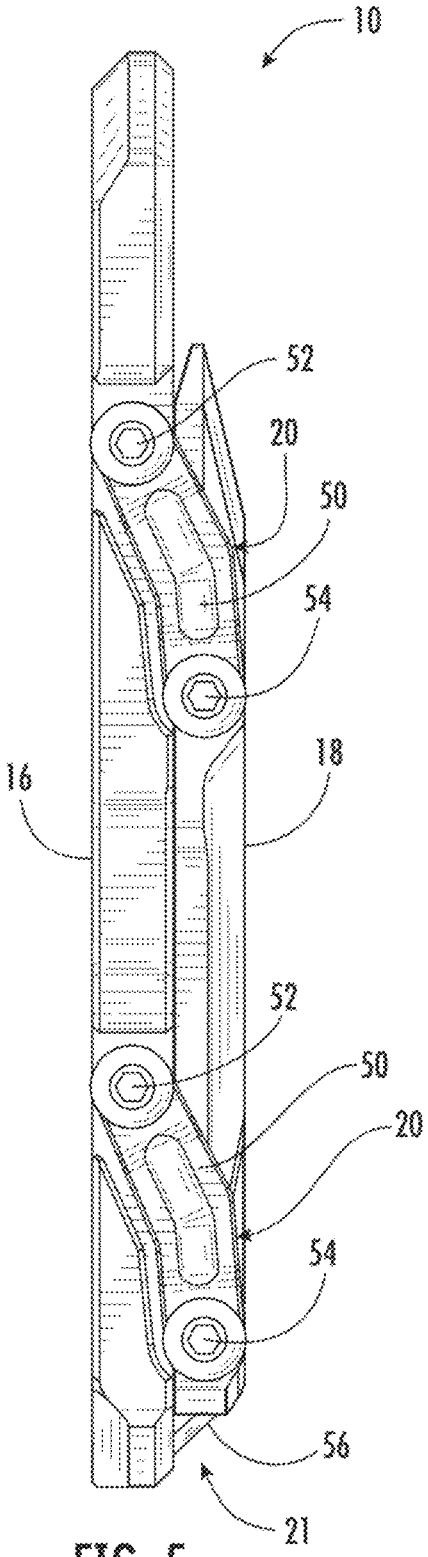
FIG. 5 is a left side elevational view of the wallet money clip of FIG. 1.
Figure 4A:
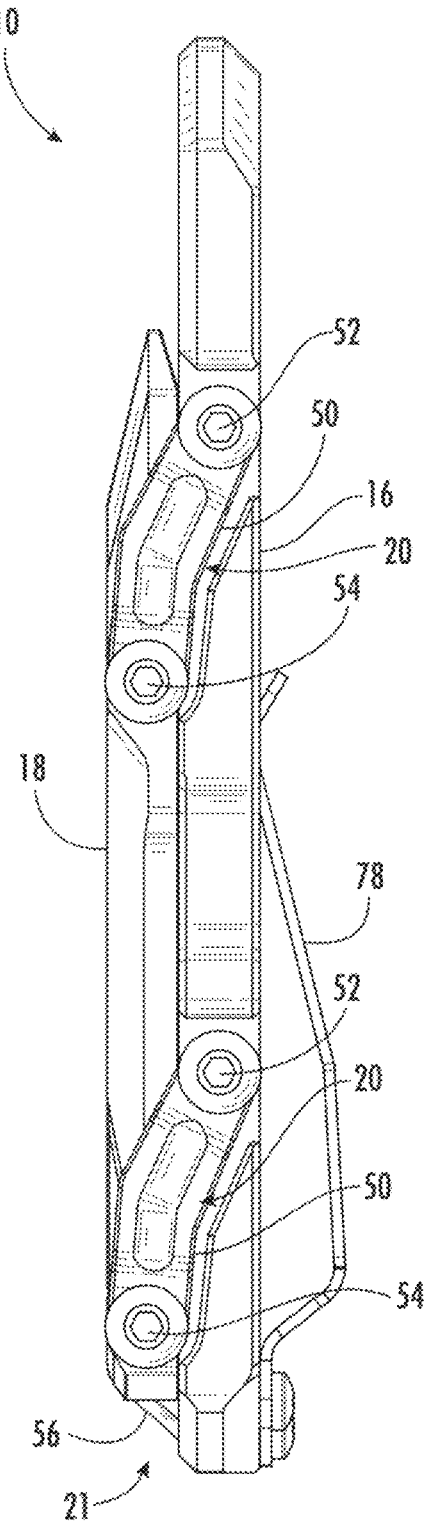
FIG. 4A is a right side elevational view of the wallet money clip of FIG. 1, further showing an optional money clip in accordance with an exemplary embodiment of the invention.
Figure 5A:
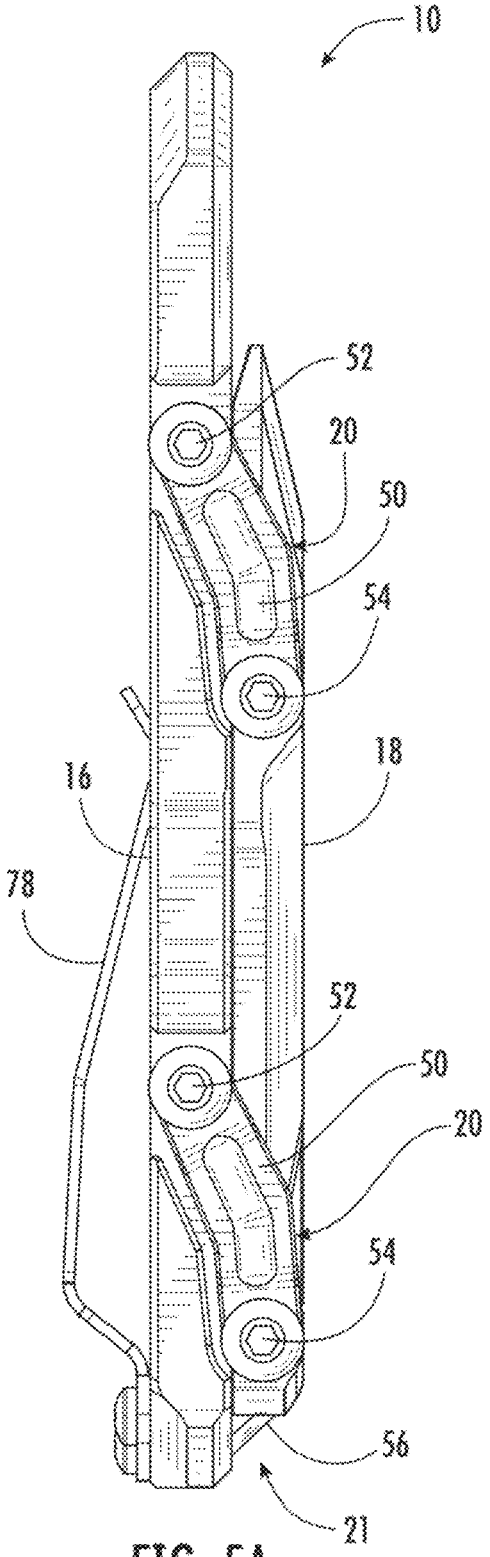
FIG. 5A is a left side elevational view of the wallet money clip of FIG. 1, further showing an optional money clip in accordance with an exemplary embodiment of the invention.
Figure 6:
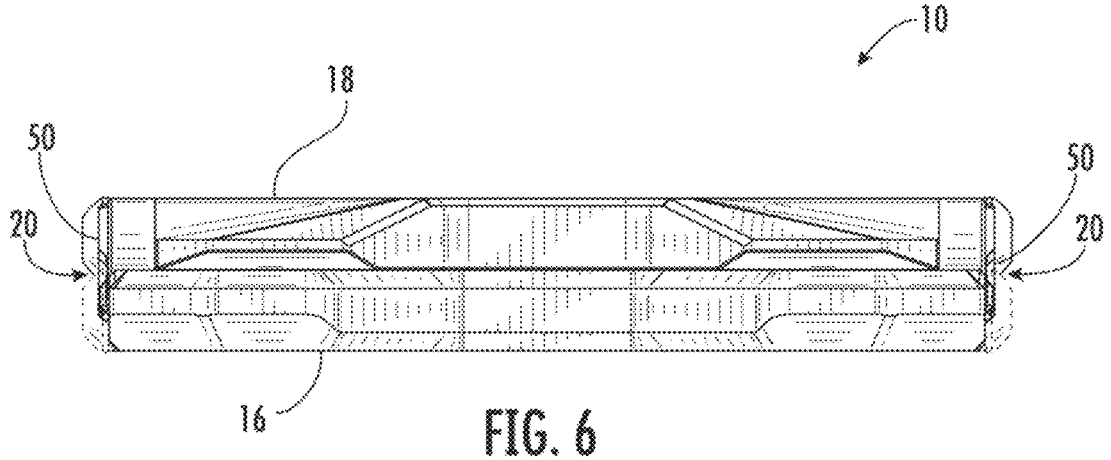
FIG. 6 is a front elevational view of the wallet money clip of FIG. 1.
Figure 7:
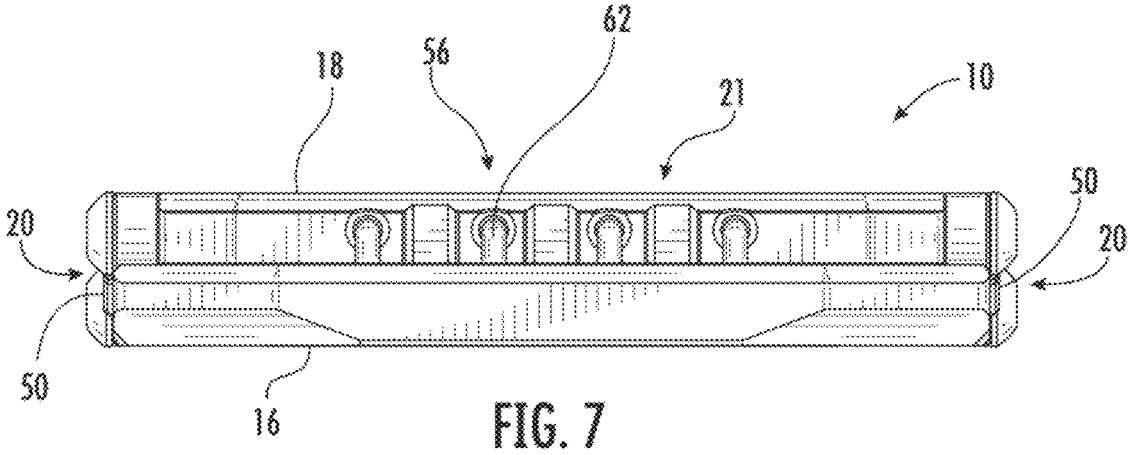
FIG. 7 is a rear elevational view of the wallet money clip of FIG. 1.
Figure 11:
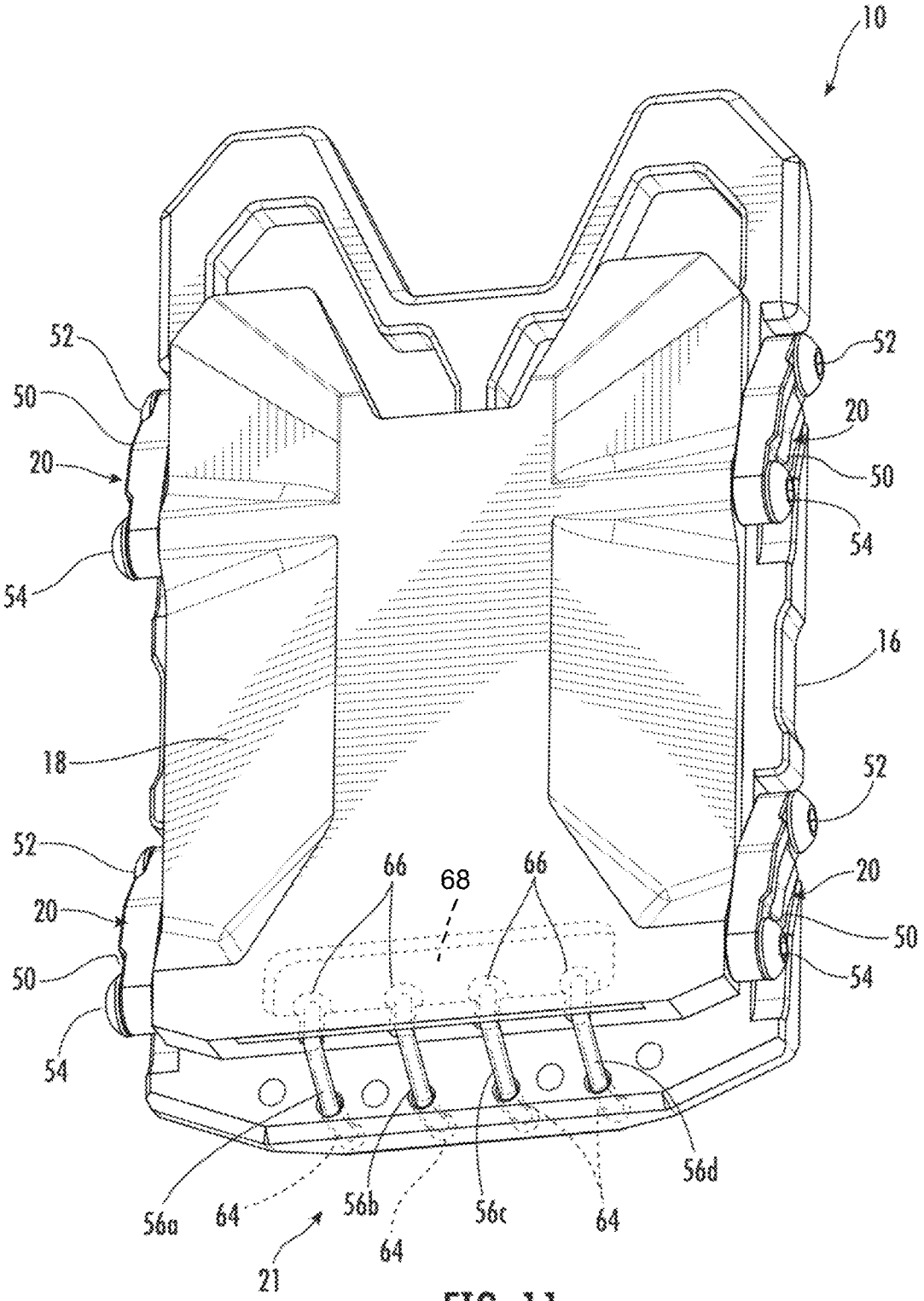
FIG. 11 is a top, right, front perspective view of a wallet money clip in an open position accordance with an exemplary embodiment of the invention.
Figure 12:
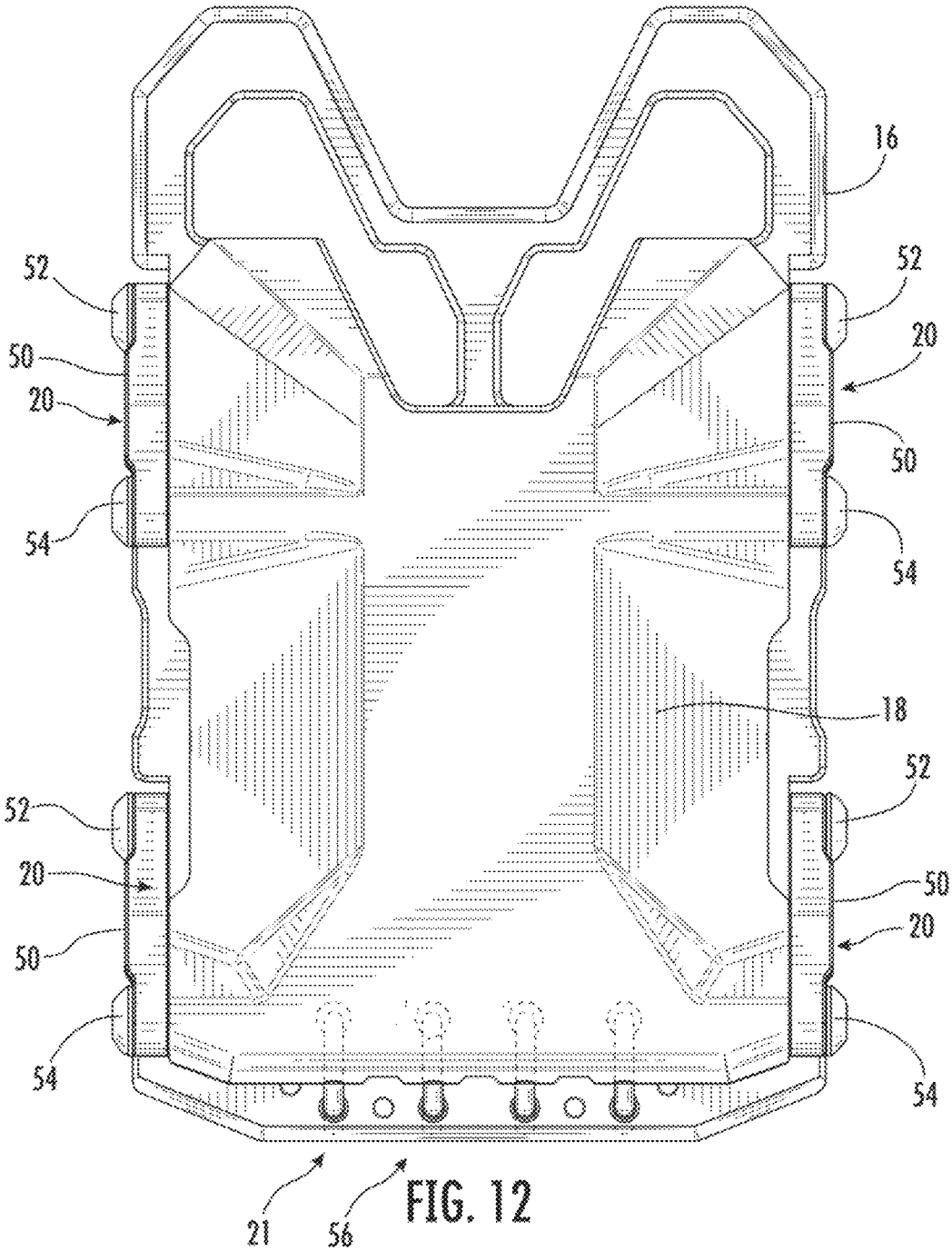
FIG. 12 is a top, right, front perspective view of a wallet money clip of FIG. 11 in a closed position.

Referring to FIG. 2, in the preferred embodiment four passageways 66*a* are shown; however, it is within the scope of the present invention to have more or less passageways 66*a* and/or the passageways 66*a* may have a greater or lesser length as desired. In the preferred embodiment, each passageway has a longitudinal length in a range of 1 inch to 2 inches and the total length of the band 56 is in a range of 6¼ inches to 10¼ inches when wallet money clip 10 is in the closed position and in a range of 8¼ inches to 12¼ inches when in the open position. In another embodiment illustrated by FIGS. 9 and 10, each passageway 66*a* has a longitudinal length in a range of ⅛ inch to ½ inch and the total length of the band 56 is in a range of 2½ inches to 6½ inches when wallet money clip 10 is in the closed position and in a range of 4½ inches to 8½ inches when in the open position. In a less preferred embodiment, a plurality of bands 56*a*-56*d* may be used in place of a single band (FIGS. 11 and 12). A cavity 68 may be provided in the bottom surface 38 of the second plate 18 in order to allow access during installation of the band 56. Likewise, a cavity 70 may be provided in the bottom surface 24 of the first plate 16 in order to allow access during installation of the band 56. Optionally, the first plate 16 and/or second plate 18 may each be configured with an upper section and a lower section to ease assembly of component parts such as the band 56, bands 56*a*-55*d* and articulation mechanisms 20.

Use of the single elastic band 56 provides a plurality of laterally spaced band sections extending between the first and second plates 16, 18. Preferably, the band 56 forms four band sections, as illustrated; however, two, three or five or more band sections may be formed. The band 56 provides a force biasing and drawing the first and second plates 16, 18 towards the closed position. Advantageously, the plurality of laterally disposed band sections communication the biasing force across the lateral width of the wallet money clip 10 with each band section applying essentially the same amount of force. A further advantage is that the single band 56 allows for a consistent and controlled stretch rate over the entirety of the band 56 resulting in a more consistent and tuned opening force to move the second plate 18 to the open position and closing force for holding and securing cards 12 within the wallet money clip 10.

Referring to FIGS. 11 and 12, it is within the scope of the invention that a plurality of laterally spaced bands 56*a*-56*d* extending between the first and second plates 16, 18 may be used in place of a single band 56.

The top surface 22 of the first plate 16, bottom surface 38 of the second plate 18, articulation mechanisms 20 and band 56 (or bands 56*a*-*d* FIGS. 11 and 12) form a pocket 72 having a frontal opening 74. The pocket 72 is sized for receiving one or more cards 12 which can be inserted and withdrawn from the pocket 72 only through the frontal opening 74 whereas the structure of the wallet money clip 10 restricts the cards 12 from exiting the pocket in any manner other than through the opening 74. Thusly, since a typically credit card 12 has a length of 3½ inches and a width of 2⅛ inches, connecting rods 50 (or 50*a* FIGS. 13-15) on respective sides of the money wallet clip 10 are located so that the distance measured longitudinally between their respective longitudinal midpoints throughout the range of opening money wallet clip 10 is 3 inches or less, and more preferably about 1½ inches to 2 inches.

The first and second plates 16, 18 can be spaced a distance apart from each other by holding onto the first plate 16 while pressing the second plate 18 forwards or forward and upwards relative to the first plate 16, thereby allowing for one or more cards 12 to be placed within or removed from the pocket 72. Maximum spacing between the first and second plates 16, 18 is reached the connecting rods 50 reach an effective perpendicular orientation at which the connector rods 50 engage respective stops 76 restricting further travel. The articulation mechanisms 20 maintains the top surface 22 of the first plate 16 and bottom surface 38 of the second plate 18 generally in parallel relationship yielding an effective height of the pocket 72 and so that at all distances of separation the first plate 16 and second plate 18 apply force to the cards 12 over a large area when securing the cards 12 in the pocket 72. Not to be construed as limiting, it is preferred that the height of the pocket 72 is in a range of ¼ inch to 1½ inches, more preferably ⅓ inch to ¾ inch, when the wallet money clip 10 is fully open.

The frontal notch 34 of the first plate 16 extends rearward a distance in a range of ⅜ inch to 1½ inches, more preferably ½ inch to 1 inch from the leading proximal edge of the first plate 16, and has a lateral width in a range of ½ inch to 1½ inches, more preferably ¾ inch to 1¼ inches, at the leading proximal edge of the first plate 16. The frontal notch 34 may be tapered such that the proximal portion of the frontal notch 34 has a greater span than the distal portion of the front notch 34, as illustrated. Furthermore, the frontal notch 34 is formed beginning about 2½ inches to 3½ inches from the trailing distal edge of the first plate 16 such that a portion of a card 12 being held in the pocket 72 extends into the frontal notch 34 for being gripped by a person.

The frontal notch 48 of the second plate 18 extends rearward a distance in a range of ⅜ inch to 1½ inches, more preferably ½ inch to 1 inch from the leading proximal edge of the second plate 18, and has a lateral width in a range of ½ inch to 1½ inches, more preferably ¾ inch to 1¼ inches, at the leading proximal edge of the second plate 18. The frontal notch 48 may be tapered such that the proximal portion of the frontal notch 48 has a greater span than the distal portion of the front notch 48, as illustrated. Furthermore, the frontal notch 48 is formed beginning about 2 inches to 2½ inches from the trailing distal edge of the second plate 18 such that a portion of a card 12 being held in the pocket 72 extends into the frontal notch 48 for being gripped by a person.

Preferably the frontal notch 34 of the first plate 16 and the frontal notch 48 of the second plate 18 have generally the same shape and size, and are suitable for a person to place their thumb and index finger respectively therein to remove one or more cards 12. In particular, when the second plate 18 is in the fully open position the frontal notch 48 of the second plate 18 perpendicularly coincides of the frontal notch 34 of the first plate 16 allowing for person to place an index finger in frontal notch 34 and thumb in frontal notch 48 to insert or remove cards 12.

Optionally, a money clip 78 may be attached to the bottom of the first plate 16 via screws 80 received within threaded openings 82 or by other suitable means. In an embodiment, the money clip 78 is made of a resilient metal and has a terminal portion biased to a closed position towards the bottom surface 24 of the first plate 16, as illustrated in FIGS. 4A, 5A, 8A and 8B. In an embodiment, the money clip 78 is made of a flexible material, for example fabric, leather and the like, wherein the first plate 16 and money clip 78 include complementary magnets 84, 86, respectively, to releasably secure the money clip 78 in a closed position, as illustrated in FIGS. 14 and 15. In the embodiments, the money clip 78 is positioned so that the ends of one or more banknotes folded in half extend to near the forwardmost end of the frontal notch 34 of the first plate 16. In this position a person can easily grasp and pull out banknotes from the money clip 78 without having to pull on the money clip 78 for separation from the first plate 16.

In an embodiment, the money clip 10 is made of durable rigid material, for example metal, plastic and the like. An advantage for using metal such as aluminum is its shielding effect to protect the cards 12 from being subject to radiofrequency identification theft.

Referring to FIG. 13, the wallet money clip 10 may be provided with a decorative tag 88. The tag 88 may include words and/or designs and may be interchangeable in order to customize the look of the wallet money clip 10. In the illustrated embodiment, the tag 88 is made of plastic or metal and selectively removable by screws.

Regardless of the foregoing detailed description of exemplary embodiments of the invention, the optimum dimensional relationships for the individual components of the invention, including variations in size, shape, thickness, form, materials, function and manner of operation, assembly and use, as well as equivalents thereof, are deemed to be readily apparent and understood by those skilled in the art. Accordingly, equivalent relationships to those shown in the accompanying drawing figures and described in the written description are intended to be encompassed by the invention, the foregoing being considered as illustrative only of the general concept and principles of the invention. Furthermore, since numerous modifications and changes will readily occur to those skilled in the art, the exemplary embodiments disclosed herein are not intended to limit the invention to the specific configuration, construction, materials and operation shown and described. Instead, all reasonably predictable and suitable equivalents and obvious modifications to the invention should be construed as falling within the scope of the invention as defined by the appended claims given their broadest reasonable interpretation in view of the accompanying written description and drawings.

That which is claimed is:

1. A wallet money clip, comprising:

a first plate, a second plate, a plurality of articulation mechanisms joining the first plate to the second plate and allowing for relative movement between the first plate and second plate, wherein the first plate, the second plate and the plurality of articulation mechanisms form a pocket capable of holding a credit card, and an actuator biasing the wallet money clip to a closed position, wherein the actuator is a single elastic band, wherein the elastic band includes a plurality of band sections that extend between the first plate and the second plate, wherein the plurality of band sections are laterally spaced from each other and wherein the plurality of band sections is three or more band sections.

2. The wallet money clip in accordance with claim 1, wherein the plurality of band sections is four or more band sections.

3. The wallet money clip in accordance with claim 1, wherein the first plate has a frontal notch and the second plate has a frontal notch and wherein the frontal notch of the second plate and the frontal notch of the first plate perpendicularly coincide when the wallet money clip is in the open position.

4. The wallet money clip in accordance with claim 1, wherein the plurality of articulation mechanisms includes at least two distal articulation mechanisms and at least two proximal articulation mechanisms, and wherein each of the plurality of articulation mechanisms includes a connecting rod that defines a distance between the first plate and the second plate when the wallet money is in the open position.

5. The wallet money clip in accordance with claim 4, wherein the two distal articulation mechanisms are joined by a shaft.

6. The wallet money clip in accordance with claim 5, wherein the shaft is laterally disposed in a passage defined in the second plate.

7. The wallet money clip in accordance with claim 6, wherein the two proximal articulation mechanisms are joined by a shaft.

8. The wallet money clip in accordance with claim 7, wherein the shaft of the two proximal articulation mechanisms is laterally disposed in a second passage defined in the second plate.

9. A wallet money clip, comprising:

a first plate, a second plate, a plurality of articulation mechanisms joining the first plate to the second plate and allowing for relative movement between the first plate and second plate, wherein the first plate, the second plate and the plurality of articulation mechanisms form a pocket capable of holding a credit card, and an actuator biasing the wallet money clip to a closed position wherein the actuator is a plurality of elastic bands.

10. The wallet money clip in accordance with claim 9, wherein the plurality of articulation mechanisms includes at least two distal articulation mechanisms and at least two proximal articulation mechanisms, and wherein each of the plurality of articulation mechanisms includes a connecting rod that defines a distance between the first plate and the second plate when the wallet money is in the open position.

11. The wallet money clip in accordance with claim 10, wherein the two distal articulation mechanisms are joined by a shaft.

12. The wallet money clip in accordance with claim 11, wherein the shaft is laterally disposed in a passage defined in the second plate.

13. The wallet money clip in accordance with claim 12, wherein the two proximal articulation mechanisms are joined by a shaft.

14. The wallet money clip in accordance with claim 13, wherein the shaft of the two proximal articulation mechanisms is laterally disposed in a second passage defined in the second plate.

15. A wallet money clip, comprising:

a first plate, a second plate, a plurality of articulation mechanisms joining the first plate to the second plate and allowing for relative movement between the first plate and second plate, wherein the first plate, the second plate and the plurality of articulation mechanisms form a pocket capable of holding a credit card, and an actuator biasing the wallet money clip to a closed position, wherein the plurality of articulation mechanisms includes at least two distal articulation mechanisms and at least two proximal articulation mechanisms, and wherein each of the plurality of articulation mechanisms includes a connecting rod that defines a distance between the first plate and the second plate when the wallet money is in the open position.

16. The wallet money clip in accordance with claim 15, wherein the two distal articulation mechanisms are joined by a shaft.

17. The wallet money clip in accordance with claim 16, wherein the shaft is laterally disposed in a passage defined in the second plate.

18. The wallet money clip in accordance with claim 17, wherein the two proximal articulation mechanisms are joined by a shaft.

19. The wallet money clip in accordance with claim 18, wherein the shaft of the two proximal articulation mechanisms is laterally disposed in a second passage defined in the second plate.

20. A wallet money clip, comprising:

a first plate, a second plate, a plurality of articulation mechanisms joining the first plate to the second plate and allowing for relative movement between the first plate and second plate, wherein the first plate, the second plate and the plurality of articulation mechanisms form a pocket capable of holding a credit card, an actuator biasing the wallet money clip to a closed position, a money clip attached to a bottom surface of the first plate, and wherein the first plate includes a magnet and the money clip includes a magnet, wherein the money clip is capable of being held in a closed position by magnetic forced between the magnet of the first plate and the magnet of the money clip.

* * * * *